US011518612B2

(12) United States Patent
Musso et al.

(10) Patent No.: US 11,518,612 B2
(45) Date of Patent: Dec. 6, 2022

(54) MULTI-COMPARTMENT REFUSE COLLECTING TRUCK BODY AND CONTROL SYSTEM

(71) Applicant: Air-Flo Manufacturing Co., Inc., Elmira Heights, NY (US)

(72) Inventors: Tom W. Musso, Bath, NY (US); Charles S. Musso, Jr., Corning, NY (US)

(73) Assignee: Air-Flo Manufacturing Co., Inc., Elmira Heights, NY (US)

( * ) Notice: Subject to any disclaimer, the term of this patent is extended or adjusted under 35 U.S.C. 154(b) by 83 days.

(21) Appl. No.: 16/999,599

(22) Filed: Aug. 21, 2020

(65) Prior Publication Data

US 2021/0032023 A1 Feb. 4, 2021

Related U.S. Application Data

(63) Continuation-in-part of application No. 16/546,910, filed on Aug. 21, 2019, now Pat. No. 11,173,682, which is a continuation-in-part of application No. 15/645,222, filed on Jul. 10, 2017, now Pat. No. 10,752,439.

(51) Int. Cl.
*B65F 3/20* (2006.01)
*B65F 3/00* (2006.01)

(52) U.S. Cl.
CPC ..... *B65F 3/201* (2013.01); *B65F 3/001* (2013.01)

(58) Field of Classification Search
CPC ..... B65F 3/208; B65F 3/001
See application file for complete search history.

(56) References Cited

U.S. PATENT DOCUMENTS 2,212,058 A 8/1940 Wood
3,756,438 A 9/1973 Steltz
4,460,307 A 7/1984 Durant et al.
(Continued)

FOREIGN PATENT DOCUMENTS

EP 0359083 A1 3/1990

OTHER PUBLICATIONS

European Search Report for Application No. 19191956.2-1009 dated Mar. 26, 2020; 8 pgs.
(Continued)

*Primary Examiner* — Jonathan Snelting
(74) *Attorney, Agent, or Firm* — Alix, Yale & Ristas, LLP

(57) ABSTRACT

A multi-compartment refuse collecting truck body includes segmented shields to close a rear opening of the compartments. The segmented shields are positioned to close a rear opening of the refuse compartments when a packing unit is raised to discharge refuse from one of the compartments. The segmented shields include a lower segment that can be placed in a packing position to allow refuse to be packing into the compartments by a packing unit, and moved to a closed position before the packing unit is raised to prevent unintended discharge of refuse from the compartments. A control system operates actuators in the packing unit and truck body in a pre-determined sequence to ensure that refuse is not mixed during unloading of the truck body and that actuators are not operated in a manner that will damage other systems of the truck body or packing unit.

8 Claims, 12 Drawing Sheets

(56) References Cited

U.S. PATENT DOCUMENTS

| | | | | |
|---|---|---|---|---|
| 5,123,801 | A | 6/1992 | O'Daniel | |
| 5,681,140 | A * | 10/1997 | Christenson | B30B 9/301 414/525.2 |
| 5,816,766 | A | 10/1998 | Clark | |
| 7,118,320 | B2 | 10/2006 | Tomassoni | |
| 2005/0220593 | A1 | 10/2005 | MacPherson | |
| 2014/0348621 | A1 | 11/2014 | Brisson et al. | |
| 2017/0121108 | A1 * | 5/2017 | Davis | B65F 3/28 |
| 2019/0009983 | A1 | 1/2019 | Musso et al. | |

OTHER PUBLICATIONS

European Extended Search Report for Application No. 20191061.9-1009 dated Oct. 29, 2020; 8 pgs.

* cited by examiner

MULTI-COMPARTMENT REFUSE COLLECTING TRUCK BODY AND CONTROL SYSTEM

BACKGROUND

The present invention relates to trucks for refuse packing, and especially to the discharge of separate materials from multi-compartment truck bodies.

Refuse collecting trucks that compact collected materials into a storage compartment are known. FIG. 1 shows a conventional single compartment, rear-loading garbage truck 10, including chassis 12, wheels 14, body 16, and cab 18. The body 16 extends longitudinally from a front end 20 to a back end 22, where a packing unit 24 is integral with the body or supported by the chassis or both the body and chassis. Hydraulic cylinders 26 are mounted to the body or other support structure 28 to operate the packing unit 24. It is known for the packing unit 24 to be attached to the body 16 by a hinged connection at the top rear edge of the body 16, which permits the packing unit 24 to be pivoted upward to an open position exposing the rear opening of the compartment. Raising the packing unit 24 allows refuse compacted in the compartment to be discharged through an opening at the back end 22 of the body 16. Prior art packing units 24 included plates on a side confronting the compartment opening to contain refuse being compacted in the compartment until the packing unit is raised. When the packing unit is raised to permit discharge of compacted refuse, the compartment opening at the back end 22 of the body 16 is opened, with some refuse typically spilling out of the compartment before the process of discharging the compacted refuse begins. If only one type of material is collected in a single compartment, opening of the single compartment and spilling of material is acceptable.

Some communities desire the separate collection and disposal of two or more kinds of materials such as non-recyclable refuse, recyclables such as metals, glass, plastics, paper goods, and food or yard waste referred to as organics. Truck bodies are known for providing multiple compartments for receiving, packing, and ejecting different types of materials. The truck body includes a packer or tailgate unit that includes an open, rear-facing sump into which the different types of materials are deposited. Packer units are provided with a sweep blade that is arranged to move through a sump and sweep material from the sump toward the storage compartment. A pack blade connected to the sweep blade then compacts the material into the storage compartment. The sump of a packer unit for a multi-compartment truck body may be divided into separate sumps by dividers to keep the materials separated during collection. The tailgate unit may have a separate sweep blade and associated pack blade to move material from each portion of the sump into a storage compartment. Alternatively, as shown in U.S. Pat. No. 7,118,320 (the '320 patent) a single sweep blade may be provided with slots to accommodate the dividers, allowing a single sweep blade and single pack blade to move material from multiple sumps into multiple compartments, reducing the redundant hydraulic actuators and materials required to provide separate sweep and pack blades for each sump and compartment.

Multiple types of materials can be collected and packed into separate compartments at the same time, since the materials are kept separate in the divided sumps and compartments. However, the materials must also be kept separate during unloading, which requires that the different materials be unloaded at different locations. In a truck body with a single packing unit servicing more than one compartment, raising the packer unit to discharge refuse opens all of the compartments at the same time, which can result in undesirable spillage and mixing of different types of materials.

U.S. Pat. No. 5,123,801 (the '801 patent) discloses a multicompartment truck body with four refuse collecting compartments. The '801 patent employs a separate packing unit for each compartment. Each of the separate packing units includes a structure defining a sump, a sweep blade, a pack blade, hydraulic actuators for the sweep and pack blades, as well as hydraulic actuators to raise and lower each of the packing units. The design of the '801 patent allows separate discharge from each of the compartments by raising the separate packing unit for the relevant compartment at a location for each type of material. However, the design of the '801 patent requires redundant structures and hydraulic systems for each of the individual packing units, which increases the cost and weight of the truck body. Separate packing units also require more maintenance and have increased costs of operation.

The '320 patent discloses a multi-compartment truck body with a single tailgate unit and a divided sump serviced by a single, slotted sweep blade connected to a single pack blade. The '320 patent discloses a fixed rear wall that spans all of the compartments and extends downward from the upper rear edge of the truck body to a location where a sweep blade moves material into the compartments. This fixed rear wall remains in place and partially retains materials in the compartments when the packing unit is raised. The several compartments are open below a bottom edge of the fixed rear wall when the tailgate unit is raised, which can result in spillage and mixing of materials. The fixed rear wall will obstruct discharge of the compacted materials from the compartments.

There is a need for a refuse collecting truck body that maintains separate material streams from collection to disposal, where the openings at the rear of the compartments are controlled such that refuse being unloaded from one opening does not intermingle with refuse associated with another opening.

SUMMARY

According to a first aspect of the invention, a multiple-compartment refuse truck body is provided with a shield arranged to selectively close a rear opening of a compartment so that when the tailgate or packer unit is raised, the material in the compartment is contained and does not mix with the material contained in the other compartments. According to a further aspect of the invention, a shield is configured to span the rear opening of a compartment in a multiple-compartment refuse truck body from an upper rear edge to a lower edge of the opening so that the rear opening is closed when the packer unit is raised. According to another aspect of the invention, a shield for closure of a rear compartment opening in a multi-compartment refuse truck body is connected to the truck body at an upper rear edge of the truck body by a pivoting or hinged connection, allowing the shield to be rotated away from the opening to allow material to be discharged from the compartment without interference. According to aspects of the invention, a shield arranged to close a rear opening of a compartment in a multi-compartment truck body is a segmented shield, with an upper segment having an upper end hingedly connected to the truck body at an upper rear edge of the truck body and a lower segment hingedly connected to a lower end of the upper segment.

According to aspects of the invention, a multi-compartment truck body for collecting separate types of material includes a segmented shield arranged between the truck body and a tailgate packer unit, where a segmented shield closes a rear opening of at least one compartment or all of the compartments when the tailgate packer unit is raised. The truck body includes actuators arranged to pivot an upper shield segment connected at an upper rear edge of the truck body to open the rear opening for discharge of material. The truck body includes actuators arranged to pivot a lower shield segment connected at a lower edge of the upper shield segment. The lower shield segment may be pivoted away from a lower edge of a compartment rear opening when the tailgate packer unit is closed, allowing material to be moved between the lower edge of the compartment rear opening and the lower shield segment and into the compartment.

According to aspects of the invention, one disclosed embodiment of a segmented or composite shield has a first position for a packing mode where the lower shield segment is angulated (raised) relative to the upper shield segment, to provide a stationary guide such that the sweep and pack blade can push or pack refuse under the lower shield segment into the compartment. In another, closed mode of operation, both shield segments are fixed or held to the body in a substantially straight configuration, thereby closing at least one or all the rear openings of compartments of a multi-compartment truck body while the packing unit is raised, and another of the segmented shields is pivoted away from the truck body to open the rear opening of a compartment before a discharge ram for that compartment is actuated to discharge material. The disclosed truck body includes actuators such as hydraulic cylinders for moving the lower shield segment between the angulated packing position and the closed position. The disclosed truck body may also be provided with actuators for lifting each composite shield from the closed position to an open position during discharge of refuse from a compartment equipped with a disclosed composite shield. Powered opening of the composite shield during refuse discharge may facilitate complete emptying of the compartments associated with the composite shield.

The composite shields have three positions: a packing position, a closed position, and an open position. In the packing position the upper shield segment is against an upper portion of a compartment opening and the lower shield segment is angulated away from a lower edge of the compartment opening while the tailgate unit is in a lowered position to collect material. In the packing position, the sweep and pack blade of the packing unit move material deposited in each of the sump compartments between the lower edge of the rear opening and the lower shield segment into a compartment associated with the sump compartment. In the closed position, both the upper and lower segments of the composite shield are positioned against the compartment rear opening, closing the rear opening of the compartment. The composite shields are moved to the closed position in preparation for raising the packing unit, so that material in the compartments does not begin to fall out of the compartment, resulting in mixing of materials. In the open position, actuators move both segments of the shield away from the rear opening to allow material to be discharged from the compartment. The actuators to open the segmented shield are associated with the upper shield segment, which moves the lower shield segment connected at a lower edge of the upper shield segment.

According to one embodiment of a truck body, all three compartments are provided with segmented shields that can be placed in each of the packing, closed and open positions by actuators. In this embodiment, when the packing unit is in a lowered position for receiving material, each of the shield lower segments are in the angulated packing position. The packing unit mates with the rear of the truck body to define separate channels for material to move from one of the sump sections into a compartment aligned with the sump section without mingling with material from the other sump sections. In the lowered position, a lower end of the packing unit may be locked to the truck body by latches. The latches have actuators to move the latches from a locked position holding the packing unit against the truck body to an unlocked position allowing the packing unit to be raised. The packing unit is connected to the upper rear edge of the truck body by a pivoting or hinge-type connection which allows the packing unit to pivot up and away from the rear openings of the compartments to a raised position where material can be discharged from the compartments.

Without sufficient training and care, an operator can make mistakes while operating a multiple-compartment refuse collecting vehicle equipped with the disclosed segmented shields. Incorrect operation includes either (1) forgetting to close the shields before raising the packing unit, which results in trash spilling out mistakenly when the packing unit is raised, or (2) forgetting to open a shield before the discharge ram is actuated to eject trash from the corresponding compartment, which could damage the door. It thus an object of the present invention to provide a reliable, automatic sequencing of operations for discharging refuse from a multiple-compartment truck body equipped with shield closures at a rear opening of the compartments.

According to an apparatus embodiment of the present disclosure, a refuse truck body comprises a main compartment and at least one side compartment, with each compartment having a rear opening extending from a roof edge to a floor edge at the rear of the truck body. A respective pushing device is provided for discharging refuse from each compartment. A segmented shield is provided for the opening of each compartment. Actuators are provided to move the segmented doors between the packing, closed and open positions. A control system is operatively connected to actuators that unlock the packing unit, actuators that raise the packing unit, actuators that angulate the lower shield segments between the packing and closed positions, actuators that move the segmented shields to the open position, and actuators that discharge material from each compartment. The disclosed truck body includes a control interface of levers, buttons or switches (control inputs) that allow an operator to select from several operational modes. A control input is provided for unlocking and raising the tailgate packer unit in preparation for discharging material from any of the compartments. When this control input is actuated, the control system is configured to first move all shield lower segments to the closed position before unlocking and then raising the packing unit. This ensures that no material is inadvertently discharged when the packing unit is raised. After the packing unit is unlocked and raised, another control input is actuated to discharge material from one of the compartments. When the control system receives a signal from the control input to discharge material from a compartment, the control system first raises the segmented door for the selected compartment and then operates a discharge ram to push material out of the compartment. After the material has been discharged, the control system returns the discharge ram to a retracted position and closes the segmented shield for the compartment. When receiving a signal to lower the packing unit, the control system ensures that all segmented shields are closed before lowering and then locking the packing unit in its lowered position. The control system may be configured to place the lower shield segments in the packing position when the packing unit is in the lowered position. The control system may be configured to ensure that the lower shield segments are in the packing position before the sweep and pack blades will function to move material from the tailgate sumps into the compartments.

The control system may be constructed to perform all of the above-described operations or may perform one or more of the above-described operations. In one embodiment, the control system may ensure the correct sequence of operations using hydraulic sequence valves in cooperation with hydraulic actuators for each moveable element. In another embodiment, the control system may include a microcontroller configured to receive signals from control inputs and actuators associated with each moveable element. The microcontroller will execute a sequence of programmed instructions in a pre-determined sequence to ensure coordinated operation of the moving structures of the disclosed multi-compartment refuse collecting truck bodies.

DETAILED DESCRIPTION

Figure 1:
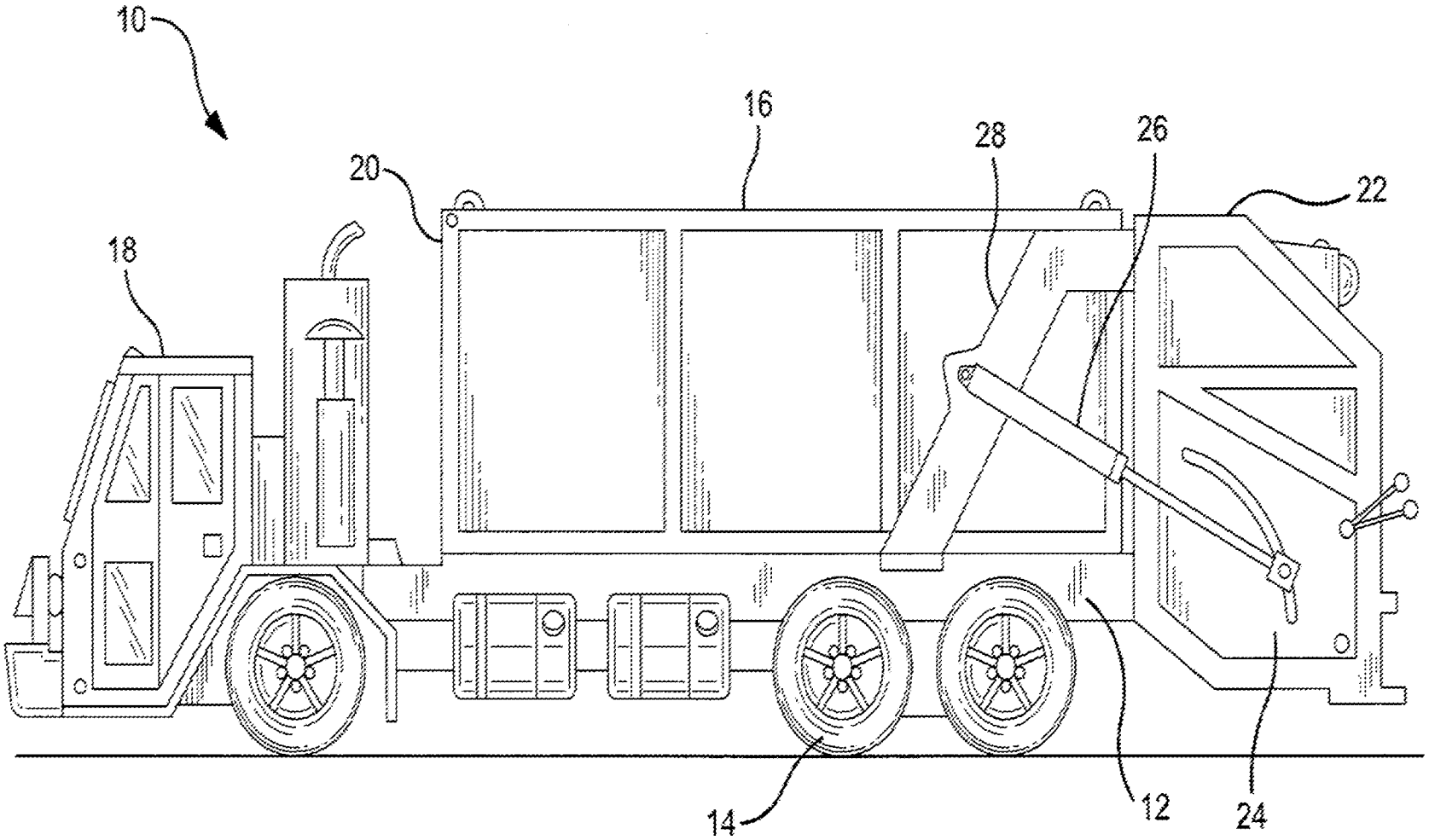
Figure 1 (Prior Art)
FIG. 1 shows a conventional single compartment, rear-loading garbage packing truck.

Alternative embodiments disclosing aspects of the invention will now be described with reference to the drawing figures. Different disclosed embodiments incorporate subsets of structures and features of the disclosed invention, with each of the alternative combinations having separate utility. The exemplary embodiments are provided for the purpose of illustration and the invention is not limited to the disclosed embodiments. The disclosed embodiments make extensive use of actuators to move components of the disclosed multi-compartment truck bodies. The actuators are disclosed in the form of hydraulic cylinders, which can be connected into a hydraulic system by those skilled in the art. Other types of actuators my be substituted for hydraulic cylinders where suitable and with appropriate modifications to the surrounding structures and control system. The term "actuator" means one or more actuators and those skilled in the art will recognize that multiple actuators may be replaced by a single actuator of greater power if appropriate structural reinforcements are provided.

Figure 2:
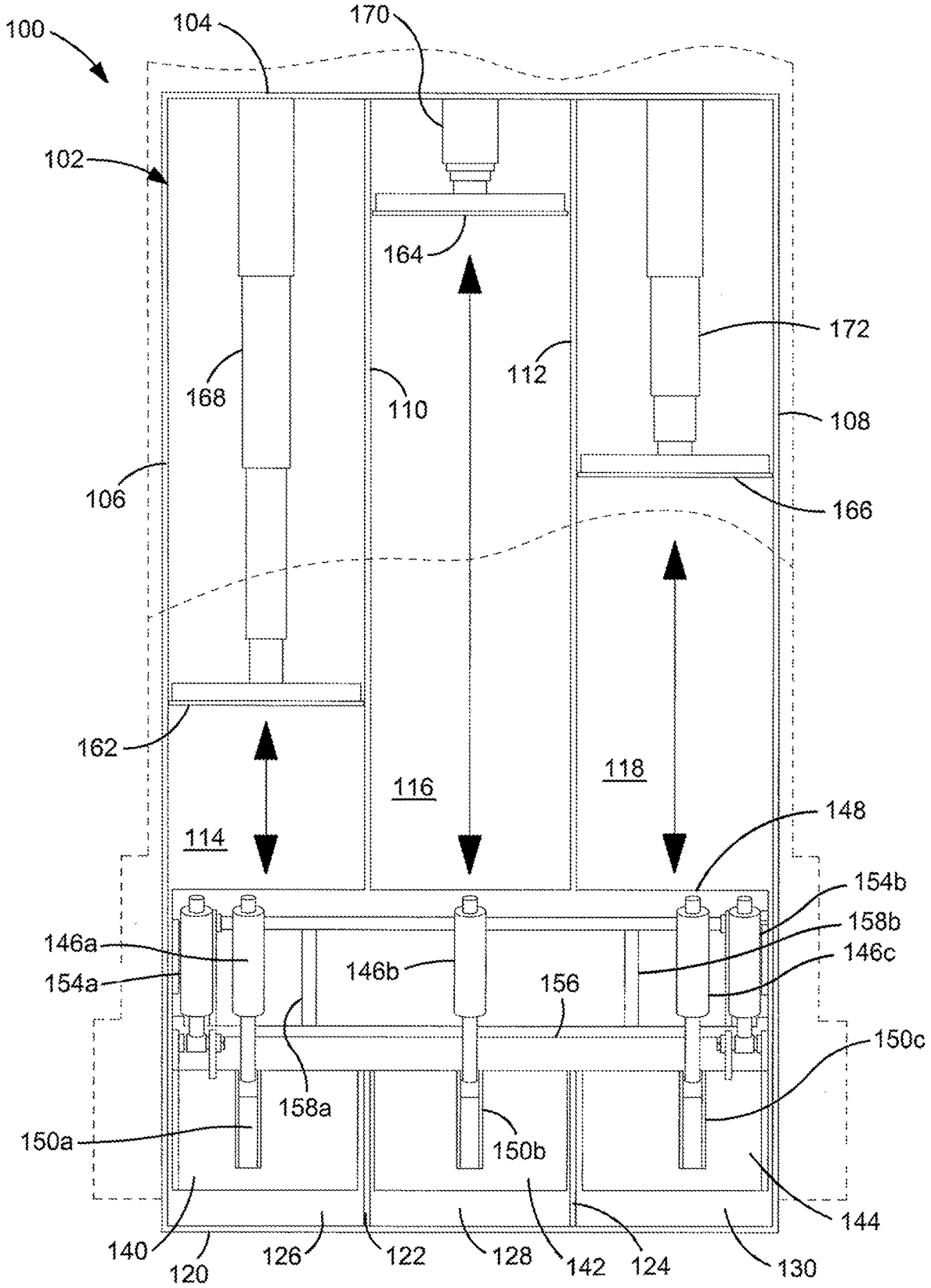
FIG. 2 is a top view of one embodiment of a rear loading three compartment refuse collecting truck body and associated packing unit with the roof removed to show internal components according to aspects of the disclosure.
Figure 8:
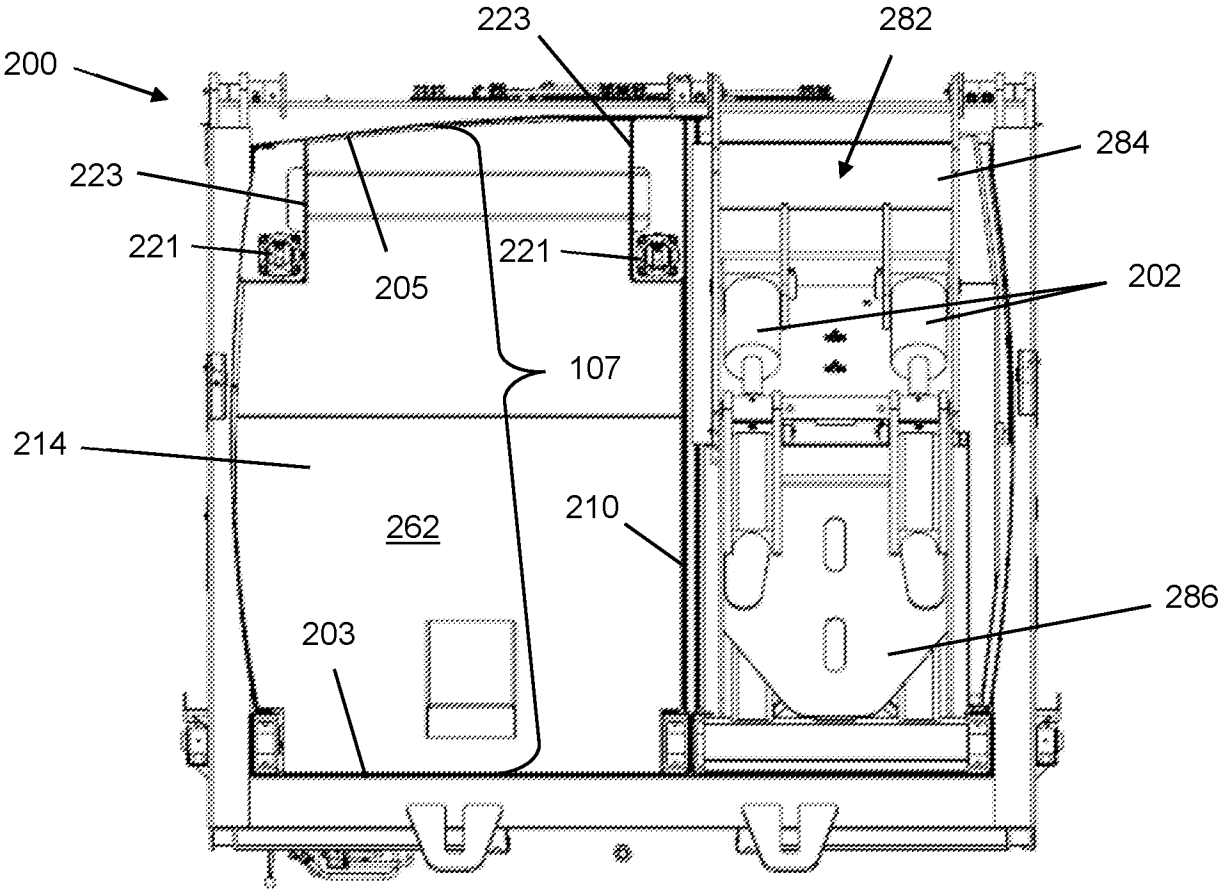
FIG. 8 is a rear view of the two-compartment refuse collecting truck body of FIGS. 5-7, with the packing unit removed and the left segmented shield removed to show the interior of the left compartment.

FIG. 2 shows an exemplary multi-compartment truck body 100 and packing unit 101 from above with the roof removed to show structures within the truck body 100 and packing unit 101. The body 100 has a frame 102 with front wall 104 and side walls 106, 108. Two laterally spaced internal walls 110, 112 cooperate with the side and front walls to define three longitudinally extending compartments 114, 116, 118. At the back end 120 of the truck body, two longitudinally extending, laterally spaced refuse separators 122, 124 in the packing unit 101 align with rear edges of the walls 110, 112, respectively, to define separate loading channels for segregated refuse. The refuse separators 122, 124 define three distinct collection sumps 126, 128, 130 in the packing unit 101. The refuse separators 122, 124, extend forwardly to abut the rear edges of walls 110, 112, when the packing unit 101 is in the loading position shown in FIGS. 3A-3D so that three separate loading channels are formed, each separate loading channel associated with a sump 126, 128, 130 and a compartment 114, 116, 118. The three refuse compartments 114, 116, 118 extend longitudinally from the front (facing the cab 18 of the refuse collecting vehicle) toward the back (adjacent the packing unit 101) of the body 100. Each compartment 114, 116, 118 has a height defined between a loading floor 103 and a ceiling 105, at a rear opening 107 (as shown in FIG. 8 for a two-compartment truck body). Three collection sumps 126, 128, 130 are defined in the packing unit 101. The collection sumps 126, 128, 130 are situated rearward of and below the compartment openings 107, to receive different types of refuse 109. When the packing unit 101 is in a loading position as shown in FIGS. 3A-3D and FIGS. 9A and 9B, a rear edge of the refuse separators 122, 124, is against the divider wall 110, 112, so the segregated refuse 109 is kept separate throughout the loading process illustrated in FIGS. 3A-3D. Each compartment 114, 116, 118 is provided with an ejection cylinder 168, 170, 172 coupled to packing faces 162, 164, 166. The ejection cylinders 168, 170, 172 are individually extendable to move a selected packing face 162, 164, 166 toward the rear of the truck body to discharge refuse from a selected compartment 114, 116, 118.

Figure 2A:
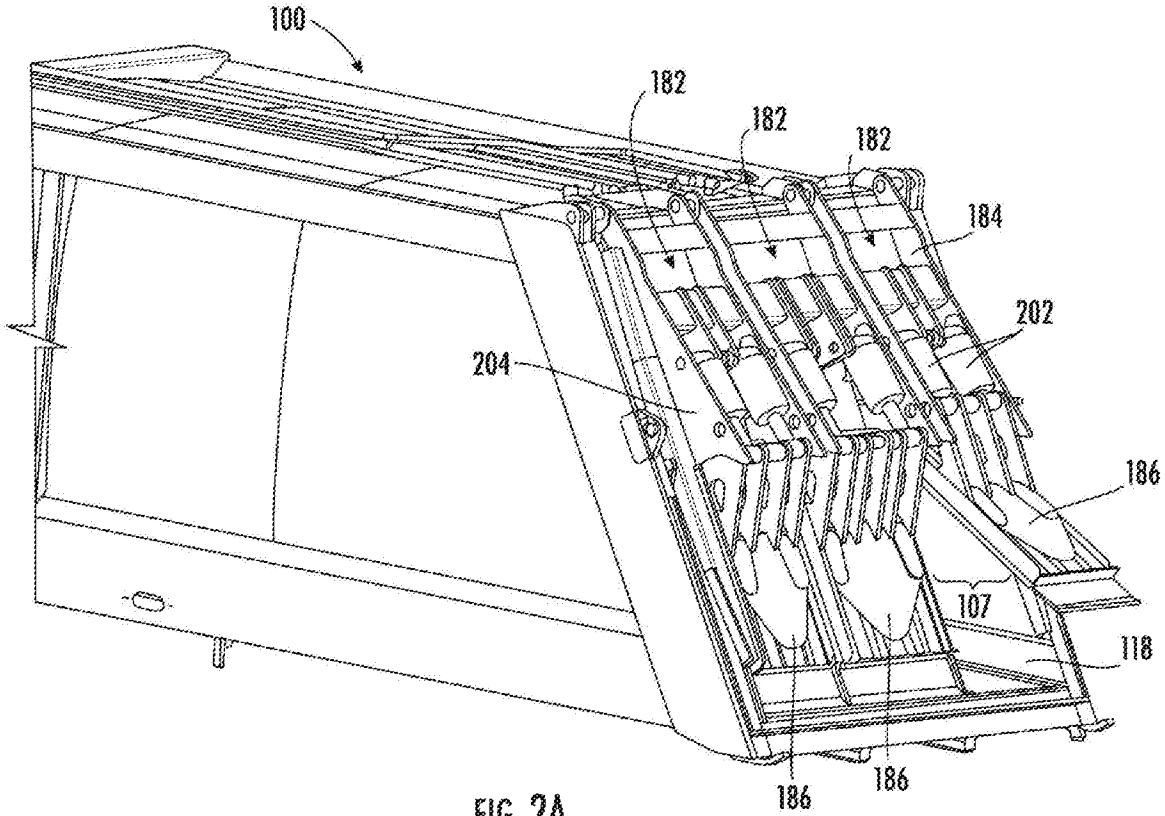
FIG. 2A is a rear perspective view of the truck body of FIG. 2, with the packing unit removed to show segmented shields arranged to close the rear openings of each of the three compartments according to aspects of the disclosure.

FIG. 2A is a rear perspective view of the truck body 100 of FIG. 2 with the packing unit 101 removed to show the three segmented shields 182 arranged to close each of the rear openings 107 of the three compartments 114, 116, 118. Each segmented shield 182 includes an upper segment 184 and a lower segment 186. The upper segments 184 are hingedly connected at the upper rear edge of the truck body 100, and the lower segments 186 are hingedly connected to the lower edge of the upper segments 184. The two segmented shields 182 covering the rear openings of the left compartment 114 and center compartment 116 are shown in the closed position where the lower segment 186 and the upper segment 184 are against a rear edge of the divider walls 110, 112, closing the rear opening 107 of the left and center compartments 114,116. Raised side walls 204 on the upper shield segments 184 provide stop limits against the packing unit 101 the packing unit is in the loading position of FIGS. 3A-3D. The segmented shield 182 for the right compartment 118 is shown with the lower segment 186 angulated relative to the upper door segment 184 to a packing position which will be explained with reference to FIGS. 3A-3D. Lower segment actuators 202 are arranged to move the lower segment 186 of each shield 182 between the closed position and the packing position. Hydraulic rod and cylinder actuators are illustrated, but other actuators maybe employed with suitable system modifications.

Figure 4:
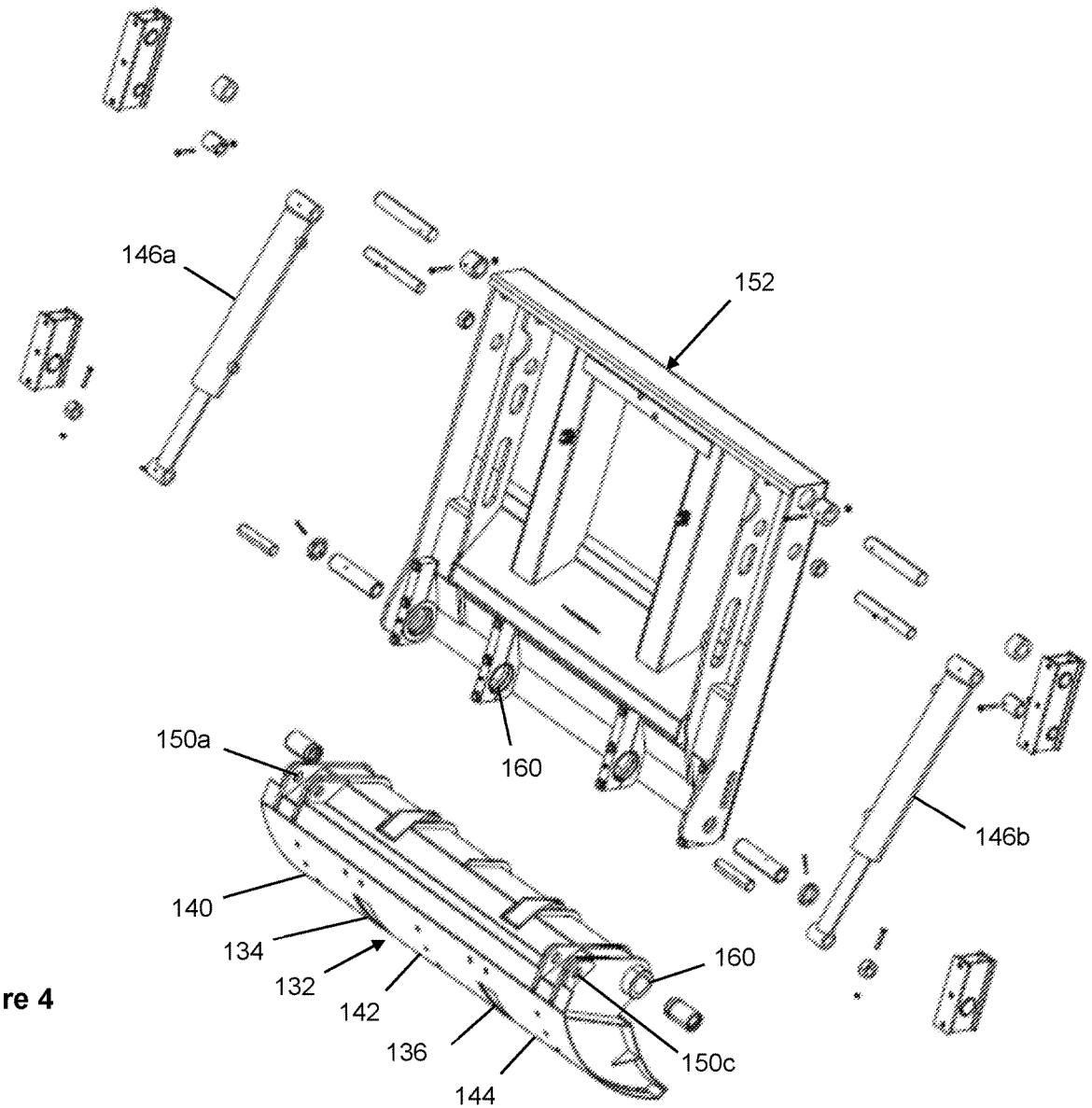
FIG. 4 is an exploded view of an exemplary combination of single pack blade and segmented sweep blade for use in a packing unit for a three-compartment refuse collecting truck body according to aspects of the disclosure.

FIG. 4 is an exploded view of a sweep blade 132 and connected pack blade 152 for use in the three-compartment truck body of FIGS. 2 and 2A. The sweep blade 132 is connected to a lower edge of the pack blade 152 at a hinged joint 160. As shown in FIG. 2, the sweep blade 132 extends laterally across all the sumps 126, 128, 130, and has three sections 140, 142, 144 corresponding to the three collection sumps, wherein the sweep blade sections 140, 142, 144 are movable respectively within each sump 126, 128, 130. The sweep blade 132 includes two slots 134, 136 that accommodate the refuse separators 122, 124, respectively, allowing the sweep blade sections to extend to the bottom of each sump 126, 128, 130, while the refuse separators 122, 124 keep different types of refuse segregated. The sweep blade 132 illustrated in FIG. 4 is a single blade that includes slots 134, 136 and is rotated about the hinged connection 160 to the pack blade 152 by two or more hydraulic actuators 146*a* and 146*c*, shown in FIG. 4. Alternatively, the sweep blade 132 could be constructed of separate blade segments, each connected at a hinge connection to a lower edge of the pack blade 152. As shown in FIG. 4, the sweep blade cylinders 146*a* and 146*c* are connected between the pack blade 152 and associated actuation arms 150*a* and 150*c* connected to the back side of the sweep blade, for pivoting the sweep blade 132. The pack blade 152 extends laterally across the packing unit 101 above the sweep blade 132, for oblique linear movement toward and away from the compartments 114, 116, 118. Pack blade cylinders 154*a*, 154*b* are shown mounted inside the body or frame of the packing unit 101 for this purpose and connect to an additional cross brace 156, but the pack blade hydraulic actuators (cylinders) 154*a*, 154*b* can alternatively be mounted outside the frame of the packing unit 101. Braces 158*a*, 158*b* are also provided between cross braces 148 and 156, as shown in FIG. 2.

A packing cycle of the disclosed packing unit 101 will be described with reference to FIGS. 3A-3D. FIGS. 3A-3D are side sectional views of a truck body 100 and associated packer unit 101 according to aspects of the invention. In these figures, the packing unit 101 is shown in the position where refuse 109 is deposited into the sumps, which will be referred to as the "loading" position of the packer 101. The upper shield segment 184 is closed against a rear edge of the divider wall 110, while the lower shield segment 186 is angulated to the packing position. The packing position of the lower shield segment 186 defines an opening between the lower shield segment 186 and the floor of the compartment 114 at the bottom of compartment opening 107. A packing cycle is performed by a sweep type packing unit 101 that can be incorporated into a refuse collecting vehicle having a body 100 divided into separate compartments 114, 116, 118 by divider walls 110, 112 as shown in FIGS. 2 and 2A. In the disclosed packing unit 101, a pack blade 152 and connected sweep blade 132 move refuse 109 from separated sumps 126, 128, 130 into the compartments 114, 116, 118. The left divider wall 110 and left compartment 114 are shown in FIGS. 3A-3D.

Figure 3B:
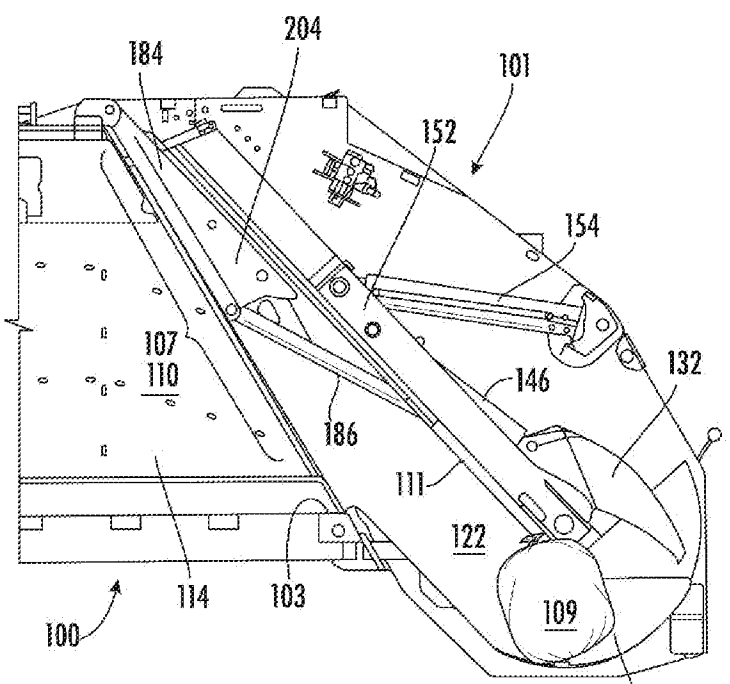
FIGS. 3A-3D illustrate a packing cycle in a packing unit for the three-compartment refuse collecting truck body according to aspects of the disclosure.
Figure 3A:
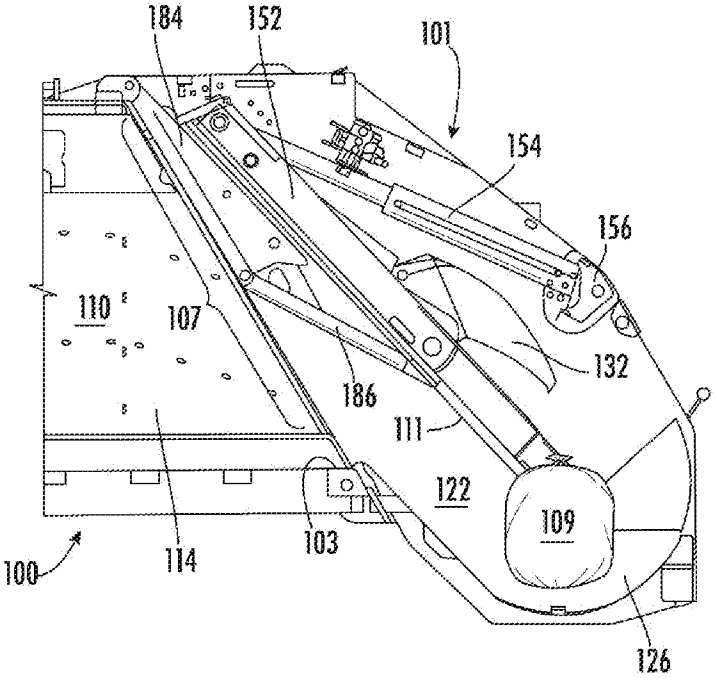
Figure 3D:
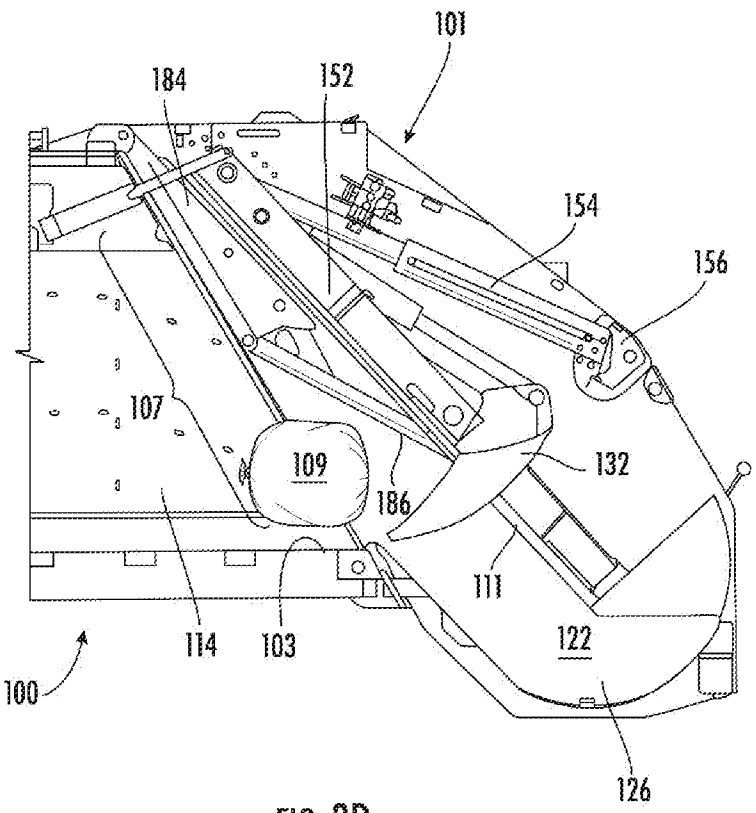
Figure 3C:
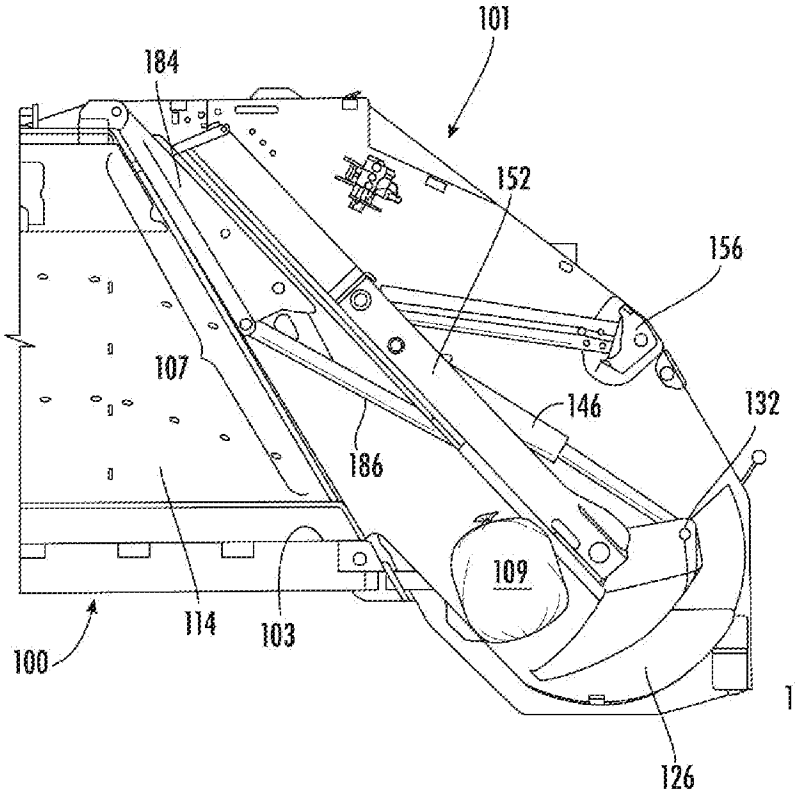

A packing cycle begins in FIG. 3A, with the pack blade 152 in a retracted position and the sweep blade 132 in an open position. Refuse 109 has been deposited in the left sump 126 associated with left compartment 114. As shown in FIG. 3B, with the sweep blade 132 in an open position, the pack blade 152 is moved to an extended position. With the pack blade 152 in the extended position and the sweep blade open as shown in FIG. 3B, the sweep blade 132 is positioned in the sump 126 with refuse 109 between the sweep blade 132 and the opening 107 to the compartment 114. In FIG. 3C, the sweep blade 132 is rotated to sweep the bottom edge of the sweep blade 132 through an arc concentric with a curved bottom of the sump 126, during which refuse 109 is swept from the sump 126 toward the opening 107 of the compartment 114. In the final step shown in FIG. 3D, the sweep blade is held in the swept position while the pack blade 152 is retracted to move refuse 109 through the opening between the lower shield segment 186 and the floor 103 of the compartment 114, with the lower segment 186 guiding refuse 109 into the compartment 114. The sump 126 is now empty and ready to receive another load of segregated refuse 109.

According to aspects of the invention, the packer unit 101 employs a single pack blade 152 and a single, slotted sweep blade 132, so the packing cycle described for sump 126 and compartment 114 is identical for sumps 128 and 130 and associated compartments 116 and 118. Retraction of actuators (hydraulic cylinders) 146, moves the sweep blade 132 from the closed (swept) position to the open position as shown in FIGS. 3A and 3B. Retraction of actuators (hydraulic cylinders) 154 move the pack blade 152 from the retracted to the extended position as shown in FIGS. 3B and 3C. Extension of hydraulic actuators 146 moves the sweep blade 132 from the open position to the swept position as shown FIGS. 3C and 3D. Finally, extension of hydraulic actuators 154 moves the pack blade 152 to the retracted position as shown in FIGS. 3A and 3D. The pack blade 152 and sweep blade 132 may be held in the retracted positions and open positions, respectively shown in FIG. 3A until another packing cycle is initiated.

As shown in FIG. 3D, the pack blade 152 is retracted and in cooperation with the angled sweep blade 132, pushes the swept refuse 109 through the channels between refuse separators 122, 124 into compartment openings 107 while maintaining segregation of the refuse between the refuse separators 122, 124. The rearward edges 111 of refuse separators 122, 124 are positioned and inclined so that the oblique, linear movement of the pack blade 152 closely follows the edges 111 of the refuse separators 122, 124. Alternatively stated, the pack blade 152 has a lower edge that is pivotally connected along a transverse axis to an upper edge of the sweep blade 132; a first drive system 146*a*, 146*b*, 146*c* pivots the sweep blade 132 around the transverse axis, over an included angle that follows the shape of the sumps 126, 128, 130; and a second drive system 154*a*, 154*b* displaces the pack blade 152 and sweep blade 132 obliquely from the sumps 126, 128, 130 to the floors 103 of the compartments 114, 116, 118.

Refuse in each compartment 114, 116, 118 is packed as the pack blade 152 and sweep blade 132 sections 140, 142, 144, push the refuse 109 into the openings 107 at the rear of the compartments 114, 116, 118. The refuse 109 is pushed against packing faces 162, 164, 166 on the ejection cylinders 168, 170, 172. The ejection cylinders 168, 170, 172 retract as the compartments 114, 116, 118 fill with packed refuse. When the truck is full and the operator is ready to empty one or more of the compartments 114, 116, 118, the entire packing unit 101 pivots upwardly to expose the compartment openings 107 at the rear of the body 100. The ejection cylinders 168, 170, 172 are extended to push the refuse out the back end of the truck into three different dumping stations for the respective three different kinds of refuse.

Figure 6:
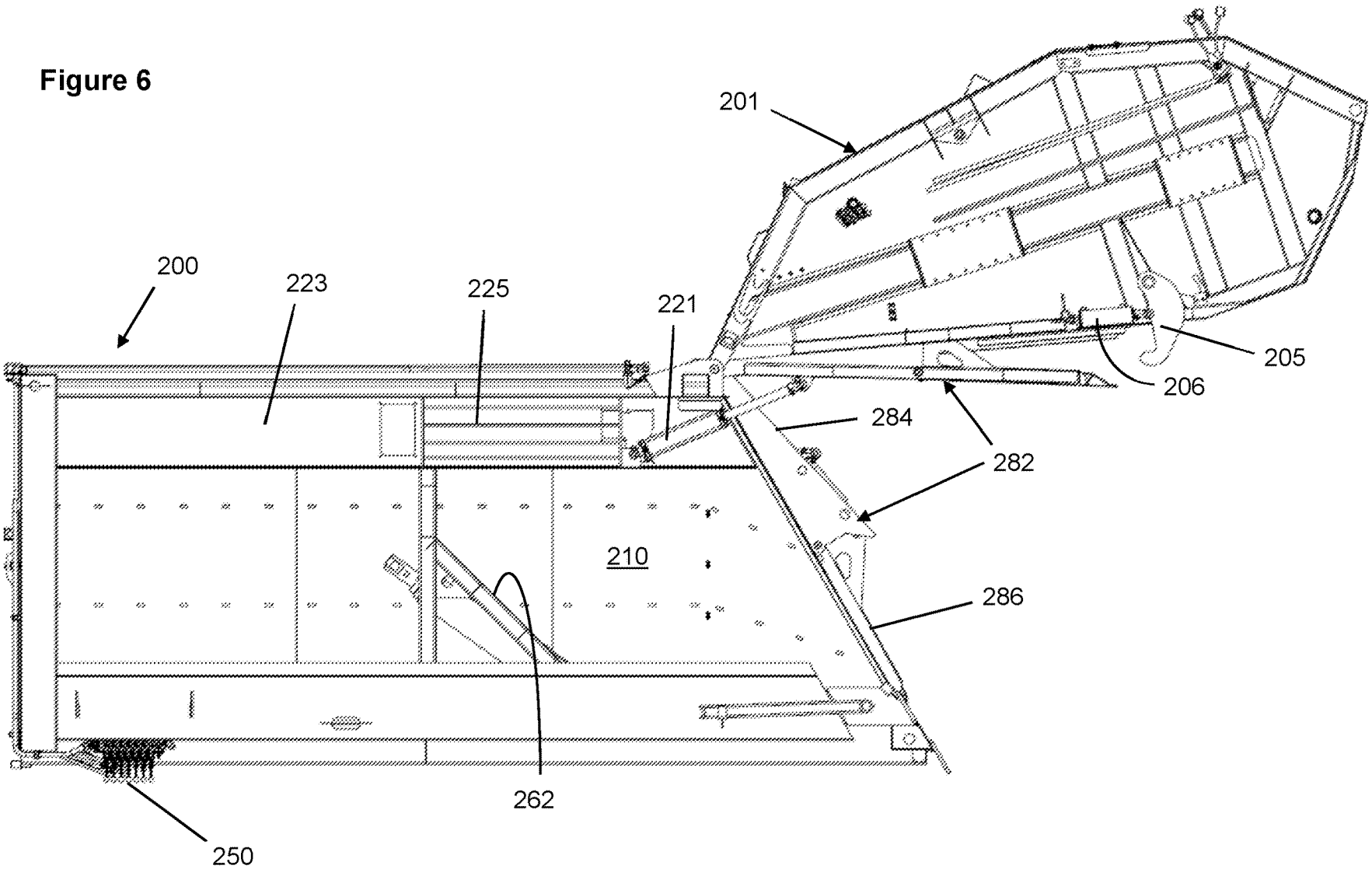
FIG. 6 is a side sectional view of the two-compartment refuse collecting truck body of FIG. 5, with the packing unit raised and the left rear segmented shield in the open position.
Figure 7:
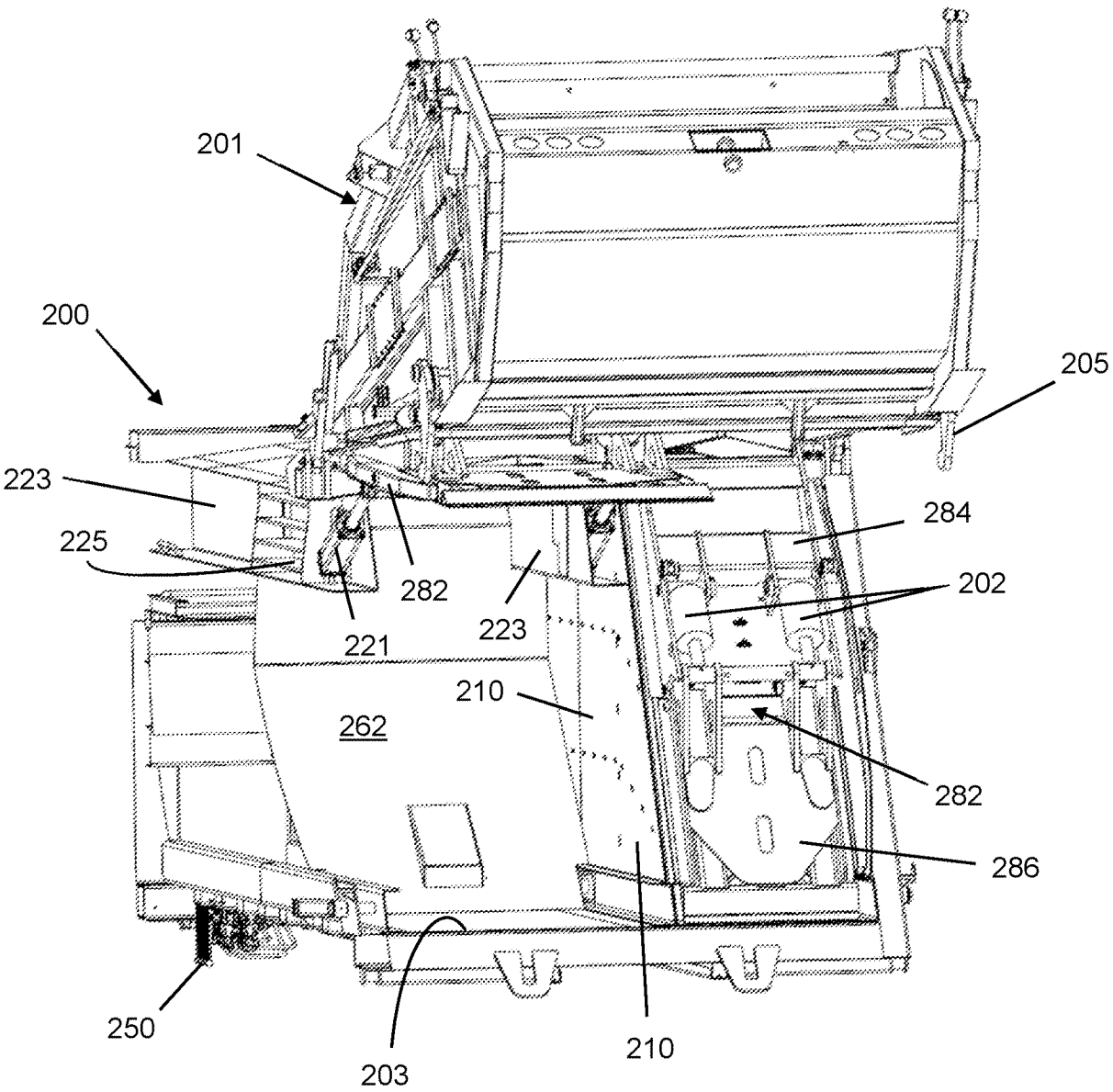
FIG. 7 is a rear perspective view of the two-compartment refuse collecting truck body of FIG. 6.

In the absence of the disclosed segmented shields 182, when the packing unit 101 is raised open as shown in FIGS. 6 and 7 for refuse ejection, there is a tendency for compacted refuse to expand and spill out the compartment openings 107 at the rear of the body 100. This is undesirable, as the type of refuse in each compartment is different and must be offloaded separately.

FIGS. 5-8 illustrate a second embodiment of a multi-compartment truck body 200 with one internal wall 210 defining two compartments 214, 216. Segmented shields 282 are provided for each compartment 214, 216. A packing unit 201 includes a refuse separator 222 to divide the sump into two collection sumps 226, 228. Each segmented shield 282 has with upper segment 284 and a pivotally connected lower segment 286. As shown in FIGS. 7 and 8, the shield upper segment 284 has a upper end connected to the upper rear edge of the truck body 200 by a hinged connection. The lower shield segment 286 is connected to the lower end of the upper shield segment 284 by a hinged connection. According to aspects of the disclosure, hydraulic lower segment actuators 202 are connected between the upper segment 284 and lower segment 286 of the composite shields 282 to selectively angulate the lower segment 286 relative to the upper segment 284 to a packing position as shown in FIGS. 3A-3D. This embodiment of a multi-compartment refuse collecting truck body 200 differs from the first embodiment 100 of FIGS. 2-4 primarily with respect to the number of compartments, and the number of associated structures. The structure and function of the packer unit 201 is substantially identical to that of packer unit 101, with the exception that the packer unit 201 has one refuse divider 222, dividing the sump into two collection sumps 226, 228 and the sweep blade 232 has a single slot to accommodate the divider 222. The structure and function of the multi-compartment refuse collecting truck body 200 is substantially identical to the structure and function of the refuse collecting truck body 100 and will be described in detail only with respect to how the truck body 200 differs from the truck body 100.

Refuse collecting truck body 200 mounts actuators 221 (hydraulic cylinders) to open and close segmented shields 282 inside the compartments 214, 216. As shown in FIGS. 6-8, the actuators 221 are mounted within a protective metal box 223 at the upper inside corners of each compartment 214, 216. The protective metal boxes 223 extend the length of the compartments 214, 216, so that the compartment has a substantially constant cross-sectional shape that facilitates the packing and discharge of refuse. The protective boxes 223 include reinforcements 225 to support the actuators 221. The packing face 262 connected to an ejection cylinder for each compartment 214, 216 has a sectional shape that corresponds to the sectional shape of the compartment, including the protective metal boxes 223, so that actuation of an ejection cylinder to advance the packing face 262 toward the compartment rear opening 207 ejects substantially all refuse from the compartment. In a longitudinal direction, the lower portion of the packing face 262 has a plow shape to scoop refuse from the floor 203 of the compartments 214, 216 and move the refuse to the rear opening 207 of the compartment 214, 216.

Figure 5:
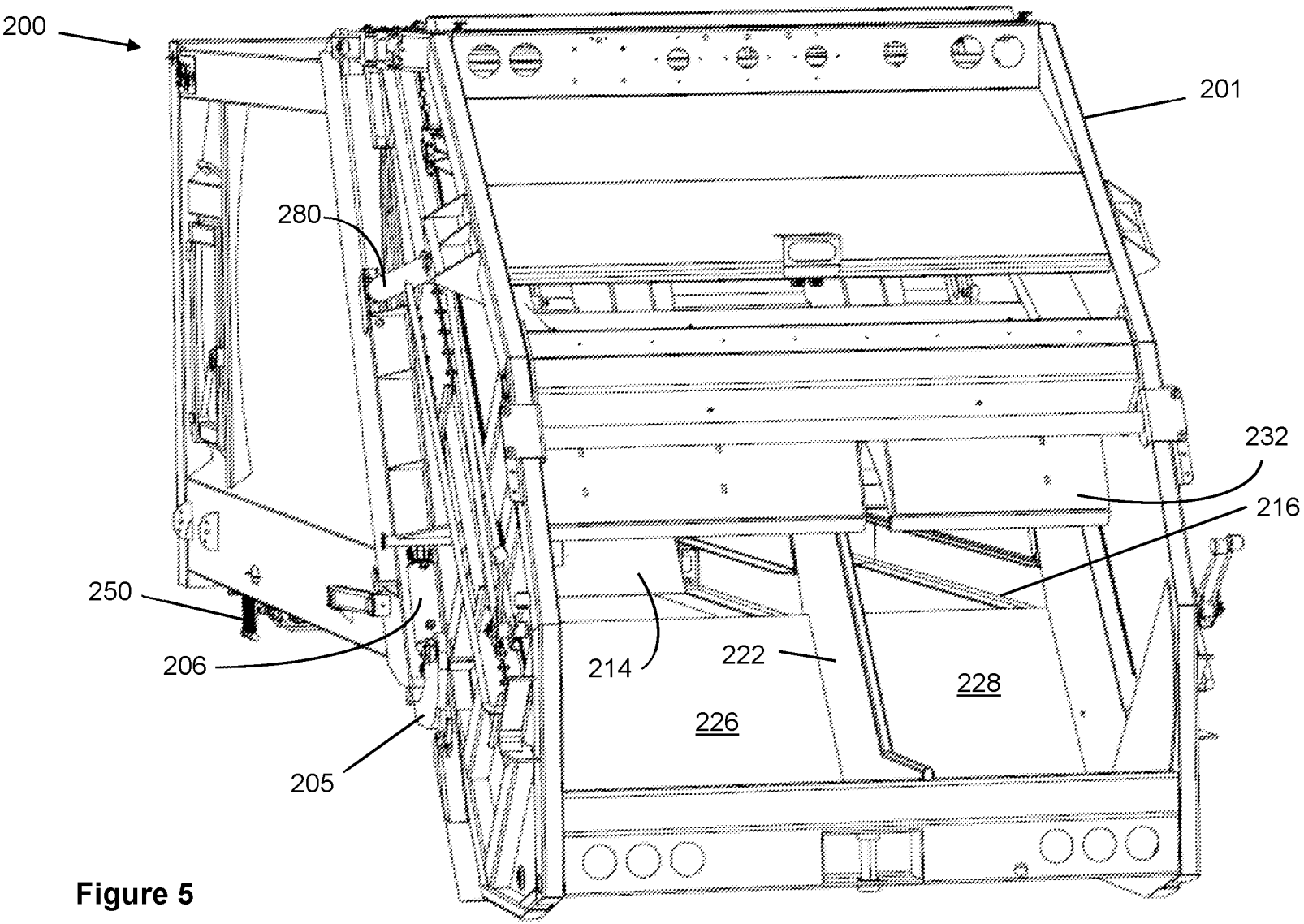
FIG. 5 is a rear perspective view of a second embodiment of a two-compartment refuse collecting truck body according to aspects of the disclosure.

FIG. 5 shows the truck body 200 in a condition to receive refuse. The packing unit 201 is in it is lowered loading position and is locked to the truck body 200 by latches 205. The position of the latches 205 is controlled by an actuator 206, so the packing unit 201 cannot be raised to the dumping position shown in FIGS. 6 and 7 unless the actuator 206 moves the latch 205 to an unlocked position. The lower segments 286 of the segmented shields 282 are in the angulated packing position to define a path for refuse into the compartments 214, 216 and are not visible in the view of FIG. 5. The sweep blade 232 is shown in the open position with the pack blade 252 retracted, corresponding to the positions shown in FIG. 3A. In this state, the truck body 200 and packing unit 201 can receive two types of refuse in the sumps 226, 228. A packing cycle as illustrated in FIGS. 3A-3D will move refuse from the sumps 226, 228 into the compartments 214, 216 as previously described.

FIGS. 6 and 7 illustrate the truck body 200 and packing unit 201 in a configuration to discharge refuse from the left compartment 214. The packing unit 201 is unlocked from the truck body 200 and has been raised to expose the rear of the truck body. The segmented shield 282 for the right compartment 216 is in the closed position so that refuse in the right compartment 216 cannot fall out inadvertently. The segmented shield 282 for the left compartment 214 has been raised to the open position by extending actuators 221. In this configuration, extension of an ejection cylinder behind packing face 262 will push refuse out of the rear opening 107 of the left compartment 214. In contrast, when the actuators 221 are retracted, the segmented shield 282 is held in the closed position. Extension of the lower segment actuators 202 maintain the lower shield segment 286 in line with the upper shield segment 284 as shown in FIGS. 6 and 7.

Figure 9B:
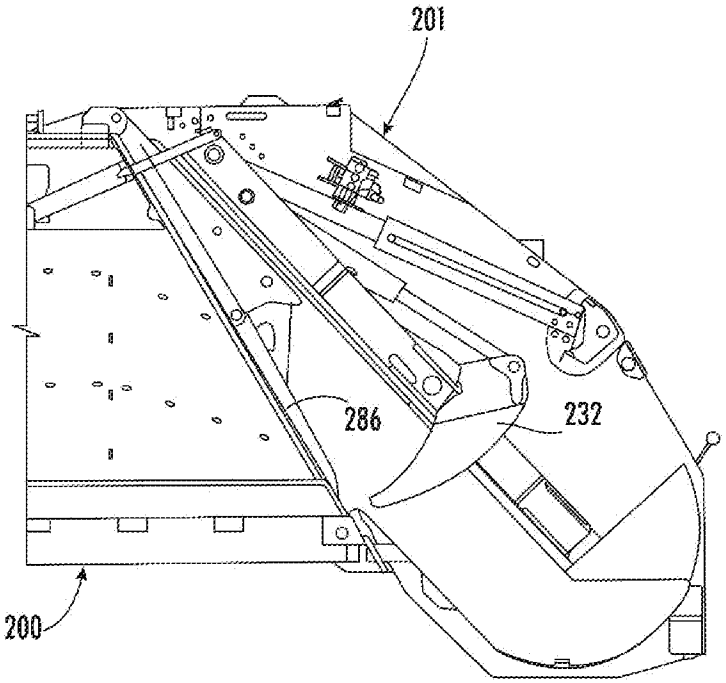
FIGS. 9A and 9B are side sectional views of a packing unit for use with the two-compartment refuse collecting truck body of FIGS. 5-8, showing movement of a lower shield segment relative to sweep blade.
Figure 9A:
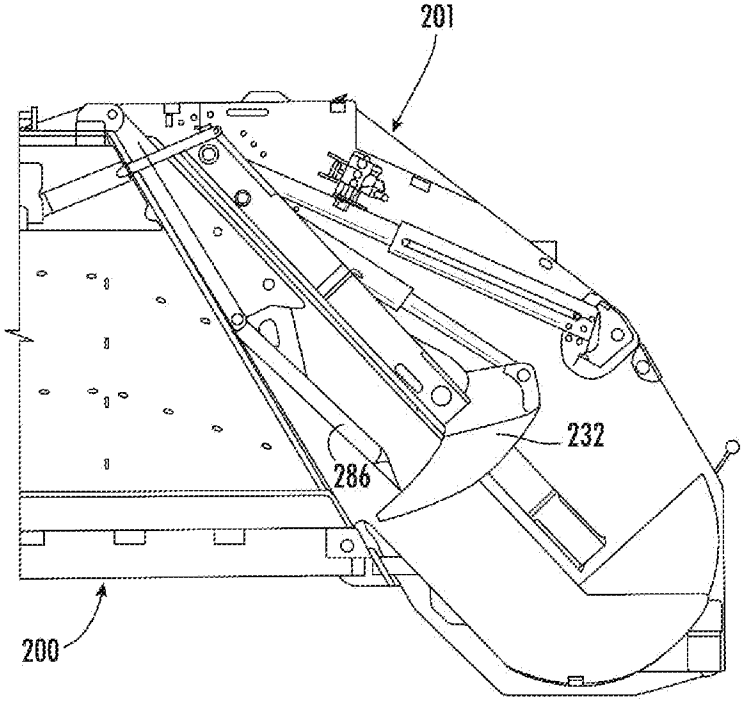

As previously described with regard to truck body 100, in preparation for unlocking and raising the packing unit, the lower shield segments 286 are moved from the packing position shown in FIGS. 3A-3D to a closed position in line with the upper shield segments 284 and against the rear end of the truck body 200 to close the compartment 214, 216. FIGS. 9A and 9B show the relative positions of the sweep blade 232 and lower shield segment 286 with the sweep blade 232 in the swept position and the pack blade 252 retracted. The lower edge of the lower shield segment 286 has clearance to move across a face of the sweep blade 232 to the closed position without the need to open the sweep blade 232. Thus, the lower shield segments 286 can be moved from the packing position to the closed position by extension of the lower segment actuators 202 as shown in FIGS. 9A and 9B before the packing unit 201 is raised. During closure of the lower shield segments 286, the upper shield segments are held in the closed position by the packing unit 201 and by the retracted actuators 221. After the packing unit 201 is raised, the actuators 221 are maintained in their retracted state, holding the segmented shields 282 in the closed position.

FIGS. 3A-3D illustrates the position of the lower shield segments 186 and the packing unit 101 during collection and packing of refuse. It will be understood that the positions of shield segments 284 and 286 of truck body 200 will correspond to the positions descried for shield segments 184 and 186 in the following discussion. When one or more of the refuse compartments 114, 116, 118 are filled with compacted refuse, the vehicle is taken to a site for the offloading of refuse into collection stations for each type of refuse. The disclosed multi-compartment refuse collecting truck bodies 100, 200 incorporate segmented shields 182, 282, that can be closed to prevent spillage and mixing of refuse that is intended to be kept separate. Operations of the several moving structures of the truck bodies 100, 200 and associated packing units 101, 201 must be coordinated to keep refuse separated and prevent actions that can potentially damage the moving structures. A control system is provided to ensure the correct sequence of operations for a desired function. The control system is operatively connected to the packing unit locking actuators 206 that unlock the packing unit 201, packing unit actuators 280 that raise the packing unit, lower segment actuators 202 that angulate the lower shield segments 286 between the packing and closed positions, shield opening actuators 221 that move the segmented shields 182, 282 to the open position, and ejection cylinders 168, 170, 172 that discharge material from each compartment 114, 116, 118. The disclosed truck body 100, 200 includes a control interface 250 of levers, buttons or switches (control inputs) that allow an operator to select from several operational modes. A control input is provided for unlocking and raising the packer unit 101, 201 in preparation for discharging material from any of the compartments. When this control input is actuated, the control system is configured to first operate the loser segment actuators 202 to move all the shield lower segments 186, 286 to the closed position before operating packing unit locking actuator 206 to unlock the packing unit 101, 201 and then operating the packing unit actuators 280 to raise packing unit 101, 201 to the unloading position. This ensures that no material is inadvertently discharged when the packing unit 101, 201 is raised.

After the packing unit 101, 201 is unlocked and raised, another control input is actuated to discharge material from one of the compartments 114, 116, 118. When the control system receives a signal from the control input to discharge material from a compartment, the control system first extends the shield opening actuators 221 to raise the segmented door 182, 282 for the selected compartment and then operates the ejection cylinder 168, 170, 172 to push material out of the selected compartment. After the material has been discharged, the control system retracts the shield opening actuators 221 to close the segmented shield 182, 282 for the compartment. When receiving a control input to lower the packing unit 101, 201, the control system ensures that all segmented shields 182, 282 are closed before lowering and then locking the packing unit 101, 201 in its lowered (loading) position. The control system may be configured to place the lower shield segments 186, 286 in the packing position when the packing unit 101, 201 is in the lowered position. The control system may be configured to ensure that the lower shield segments 186, 286 are in the packing position before the sweep and pack blades will function to move material from the tailgate sumps into the compartments, e.g., the lower shield segments 186, 286 must be in the packing position before a packing cycle can begin.

The control system may be constructed to perform all of the above-described operations or may perform one or more of the above-described operations. In one embodiment, the control system may ensure the correct sequence of operations using hydraulic sequence valves in cooperation with hydraulic actuators for each moveable element. In another embodiment, the control system may include a microcontroller configured to receive signals from control inputs and actuators associated with each moveable element. The microcontroller will execute a sequence of programmed instructions in a pre-determined sequence to ensure coordinated operation of the moving structures of the disclosed multi-compartment refuse collecting truck bodies.

Figure 10:
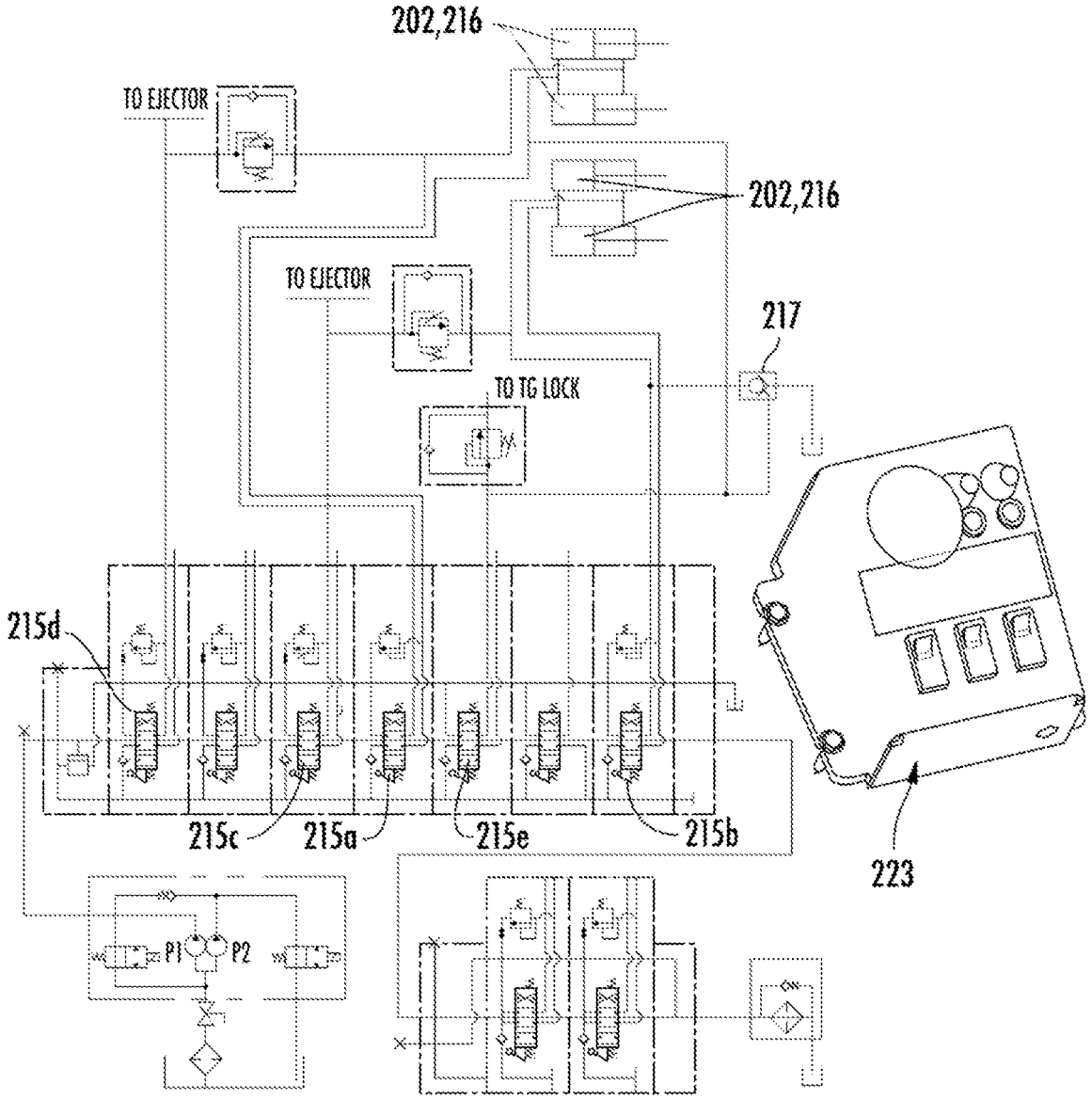
FIG. 10 is a hydraulic schematic for implementing a hydraulic valve configuration and control system to manage sequential operations in the disclosed multi-compartment refuse collecting truck bodies.

FIG. 10 is a hydraulic schematic showing a control system based upon hydraulic sequencing valves 215*a*-215*e* that can be used to control operation of the actuators to move components of the truck bodies 100, 200 in a coordinated fashion. It will be understood by those skilled in the art that similar functionality can be produced using electronic controls and that the disclosed functionality is not limited to a control system employing hydraulic sequence valves. An example of a control box 223 associated with such an electronic control system is shown in FIG. 10. The control box 223 may include a microcontroller with memory loaded with firmware configured to receive inputs from the control interface 250 and actuate hydraulic valves according to a programmed sequence to produce the coordinated sequence of actions described above. The use of electronic controls, including the connection and programming of a control box 223 are well-understood and can be implemented by those skilled in the art.

We claim:

1. A rear loading multi-compartment refuse truck body comprising:

a first compartment having a first rear opening extending from an upper rear edge of the truck body to a floor of the compartment at a rear end of the truck body;

a first ejection cylinder arranged to push refuse from the first compartment through said first rear opening;

a first elongated shield hingedly coupled to the upper rear edge of said truck body;

a first shield opening actuator coupled to said first elongated shield, said first shield opening actuator configured to move the first elongated shield between a closed position against said truck body spanning said first rear opening to an open position pivoted away from said truck body allowing refuse to be discharged from said first rear opening;

a second compartment having a second rear opening extending from an upper rear edge of the truck body to a floor of the compartment at the rear end of the truck body;

a second ejection cylinder arranged to push refuse from the second compartment through said second rear opening;

a second elongated shield hingedly coupled to the upper rear edge of said truck body;

a second shield opening actuator coupled to said second elongated shield, said second shield opening actuator configured to move the second elongated shield between a closed position against said truck body spanning said second rear opening to an open position pivoted away from said truck body allowing refuse to be discharged through said second rear opening;

each said first and second elongated shield comprising a rigid upper segment and a rigid lower segment;

said rigid upper segment having an upper end that is hinged at the upper rear edge of the truck body and an opposite lower end;

said rigid lower segment having an upper end that is hinged to the lower end of the upper segment and extending to a lower end at the floor of the compartment; and a lower segment actuator arranged to selectively pivot the lower segment relative to the upper segment between a packing position and a closed position, wherein in the packing position, the lower end of the lower segment is pivoted away from the truck body to define an opening between the lower segment and the floor of the compartment and in the closed position, the lower segment is against the truck body and together with the upper segment closes the rear opening of the compartment;

a control system operatively connected to the ejection cylinder and a door opening actuator for each of said first and second compartments, wherein said control system operates the door opening actuator for a respective compartment to move the elongated shield for a respective compartment to the open position before operating the ejection cylinder to push refuse from the respective compartment.

2. The refuse truck body of claim 1, including a packing unit pivotally connected at the upper rear edge of the truck body, said packing unit moveable between a loading position against the rear end of the truck body and an unloading position where the packing unit is pivoted upward and away from the rear end of the truck body, said elongated shields arranged between the packing unit and the truck body so that when the packing unit is pivoted to the unloading position, the first and second elongated shields span the first and second rear openings.

3. The truck body of claim 2, wherein the packing unit includes a sump for collection of refuse, a refuse separator dividing the sump into a collection sump for each compartment and a sweep blade arranged to move refuse from each collection sump into the compartments between the lower cnds end of the lower segment of the first and second elongated shield and the floor of the compartment when the lower segment is in the packing position.

4. The truck body of claim 3, wherein the control system is configured to operate said sweep blade only when the lower segment of the first and second elongated shields are in the packing position.

5. The refuse truck body of claim 1, including a packing unit pivotally connected at the upper rear edge of the truck body, said packing unit moveable between a loading position against the rear end of the truck body to an unloading position where the packing unit is pivoted upward and away from the rear end of the truck body, said elongated shields arranged between the packing unit and the truck body so that when the packing unit is pivoted to the unloading position, the first and second elongated shields span the first and second rear openings, wherein said truck body includes packing unit actuators arranged to move said packing unit from the loading position to the unloading position, and wherein said control system is configured to operate the lower segment actuator to move said lower segments of each said first and second elongated shield from a packing position to a closed position before operating the packing unit actuators to move the packing unit from the loading position to the unloading position.

6. The truck body of claim 5, wherein said control system includes a microcontroller configured to receive inputs from a control interface, said microcontroller programmed to coordinate operation of said lower segment actuators with operation of said packing unit actuators.

7. The truck body of claim 1, wherein the first and second shield opening actuators and said first and second ejection cylinders are hydraulic cylinders, and the control system includes hydraulic sequence valves to coordinate operation of the first and second shield opening actuators, with operation of the first and second ejection cylinders.

8. The truck body of claim 1, wherein the control system includes a microcontroller configured to receive inputs from a control interface, said microcontroller programmed to coordinate operation of the first and second shield opening actuators with operation of the first and second ejection cylinders.

* * * * *